US010951983B2

(12) United States Patent
Shultz et al.

(10) Patent No.: US 10,951,983 B2
(45) Date of Patent: Mar. 16, 2021

(54) CONFERENCE MICROPHONE

(71) Applicant: Marshall Electronics, Inc., Torrance, CA (US)

(72) Inventors: Leonard Marshall Shultz, Torrance, CA (US); Alex Sukharev, Torrance, CA (US)

(73) Assignee: MARSHALL ELECTRONICS, INC., Torrance, CA (US)

( * ) Notice: Subject to any disclaimer, the term of this patent is extended or adjusted under 35 U.S.C. 154(b) by 0 days.

(21) Appl. No.: 16/691,091

(22) Filed: Nov. 21, 2019

(65) Prior Publication Data

US 2020/0162815 A1 May 21, 2020

Related U.S. Application Data

(60) Provisional application No. 62/770,454, filed on Nov. 21, 2018.

(51) Int. Cl.

| | |
|---|---|
| ***H04R 3/00*** | (2006.01) |
| ***H04R 1/40*** | (2006.01) |
| ***H04R 1/04*** | (2006.01) |
| ***H04R 19/04*** | (2006.01) |

(52) U.S. Cl.

CPC ..... *H04R 3/005* (2013.01); *H04R 1/04* (2013.01); *H04R 1/406* (2013.01); *H04R 19/04* (2013.01); *H04R 2420/09* (2013.01)

(58) Field of Classification Search

CPC ..... H04R 3/005; H04R 1/406; H04R 19/04; H04R 1/04; H04R 11/04; H04R 2420/09; H04R 7/20

See application file for complete search history.

(56) References Cited

U.S. PATENT DOCUMENTS

| | | | | |
|---|---|---|---|---|
| 6,173,059 | B1 * | 1/2001 | Huang | H04R 1/406 379/202.01 |
| 2006/0228692 | A1 * | 10/2006 | Seshadri | G09B 5/06 434/365 |
| 2012/0288079 | A1 * | 11/2012 | Burnett | H04M 1/7253 379/202.01 |
| 2013/0316752 | A1 * | 11/2013 | Bodley | H04B 7/26 455/517 |
| 2015/0334498 | A1 * | 11/2015 | Case | H04R 29/004 381/58 |
| 2017/0105066 | A1 * | 4/2017 | McLaughlin | H04R 3/005 |

* cited by examiner

*Primary Examiner* — Yogeshkumar Patel

(74) *Attorney, Agent, or Firm* — Welsh Flaxman & Gitler LLC

(57) ABSTRACT

A conference microphone having a housing which encloses plural microphones is disclosed. Within the housing are a directional boundary microphone which includes three cardioid condenser capsules and an omnidirectional microphone. The housing has a rear edge wall and the directional boundary microphone includes an input end facing away from the rear edge wall of the housing. A lavaliere microphone is selectively connected to the housing via an auxiliary microphone input. A microprocessor is linked to a control panel for actuation by a user to control which of the directional boundary microphone, the omnidirectional microphone and the lavaliere microphone are active.

9 Claims, 6 Drawing Sheets

CONFERENCE MICROPHONE

CROSS REFERENCE TO RELATED APPLICATION

This application claims the benefit of U.S. Provisional Patent Application Ser. No. 62/770,454, entitled "CONFERENCE MICROPHONE," filed Nov. 21, 2018, which is incorporated herein by reference.

BACKGROUND OF THE INVENTION

1. Field of the Invention

The present invention relates to a conference microphone.

2. Description of the Related Art

While conference microphones have become a ubiquitous part of corporate life, available conference microphones offer limited functionality and versatility. Available conference microphone systems provide a "one size fits all" solution that forces users to adapt to the system rather than adapting the system to users.

The present conference microphone provides a versatile conference microphone offering great sound and a high degree of functionality designed to suit the specific needs of users.

SUMMARY OF THE INVENTION

It is an object of the present invention to provide a conference microphone. The conference microphone has a housing. A directional boundary microphone is positioned with the housing and includes three cardioid condenser capsules. An omnidirectional microphone is positioned within the housing. A lavaliere microphone is selectively connected to the housing via at least one auxiliary microphone input. A microprocessor is linked to a control panel for actuation by a user to control which of the directional boundary microphone, the omnidirectional microphone, and the lavaliere microphone are active.

It is also an object of the present invention to provide a conference microphone wherein the three cardioid condenser capsules are arranged in a pyramid.

It is another object of the present invention to provide a conference microphone wherein the housing has a rear edge wall and the directional boundary microphone includes an input end facing away from the rear edge wall of the housing.

It is a further object of the present invention to provide a conference microphone wherein the control panel includes a mute button.

It is yet another object of the present invention to provide a conference microphone including a USB Hub adapted to be connected to a computer for control and operation of the conference microphone.

It is yet a further object of the present invention to provide a conference microphone including a plurality of auxiliary microphone inputs.

It is still another object of the present invention to provide a conference microphone wherein the housing includes a top wall, a bottom wall, lateral side walls extending between the top wall and the bottom wall, a front edge wall extending between the top wall and the bottom wall, and a rear edge wall extending between the top wall and the bottom wall, and wherein a majority of the top wall and lateral side walls are comprised of a mesh material allowing for the passage of audio therethrough.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
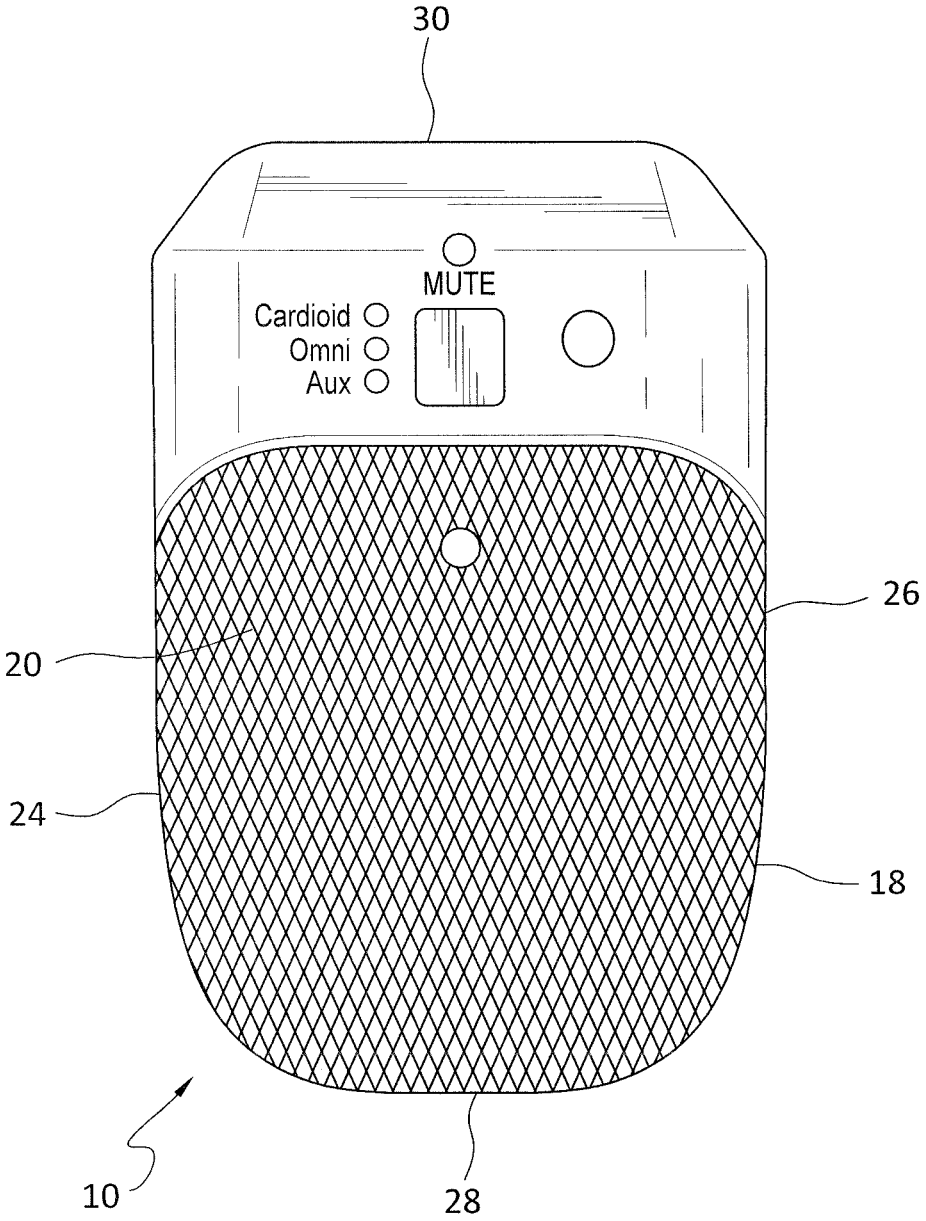
FIG. 1 is a top plan view of the present conference microphone.
Figure 2:
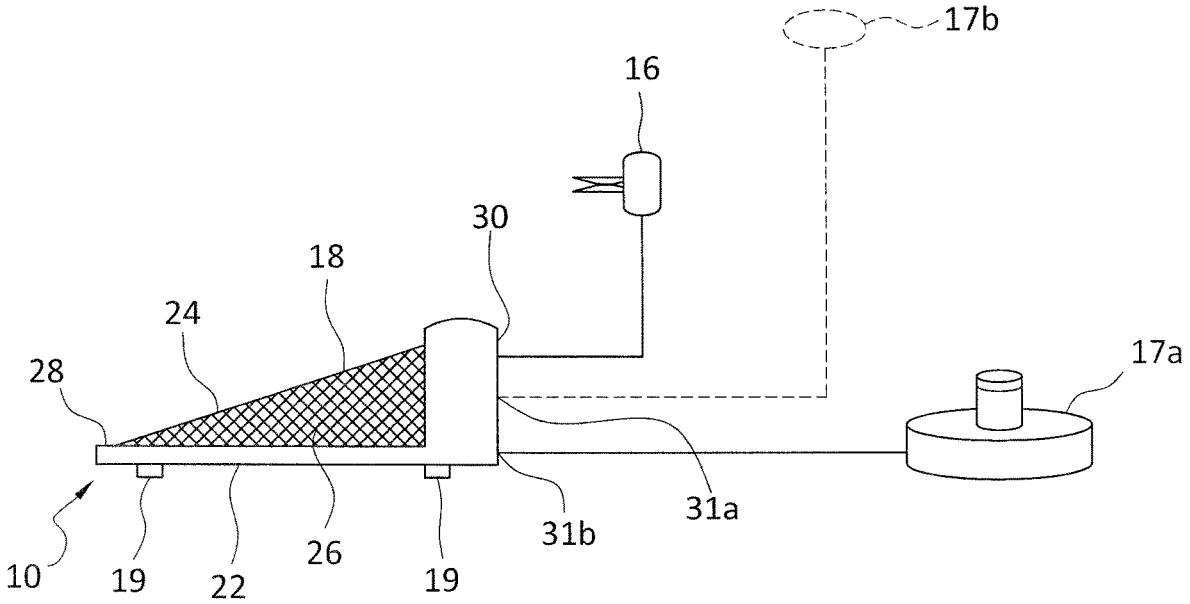
FIG. 2 is a side view of the conference microphone shown in FIG. 1.
Figure 3:
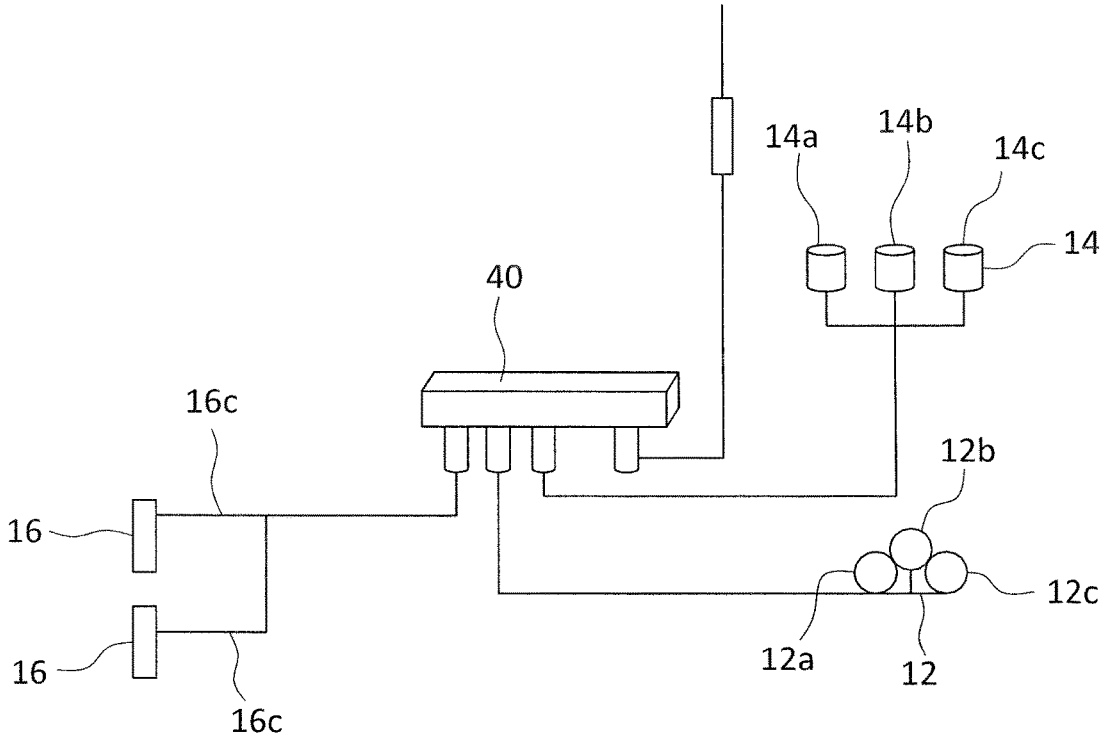
FIG. 3 is a schematic of the electronics and microphones in accordance with the conference microphone of FIG. 1.
Figure 4:
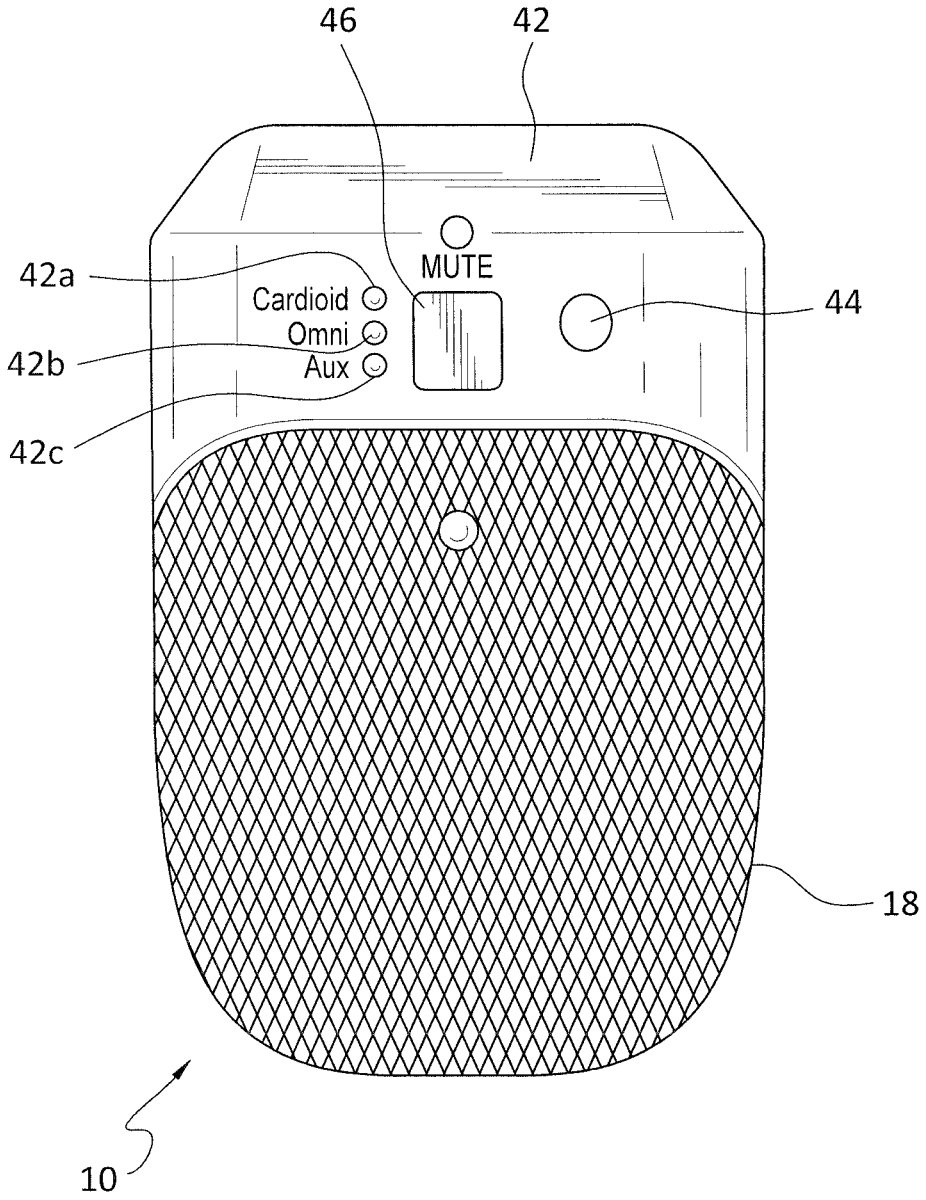
FIG. 4 is a top plan view focusing upon the control module of the conference microphone of FIG. 1.
Figure 5:
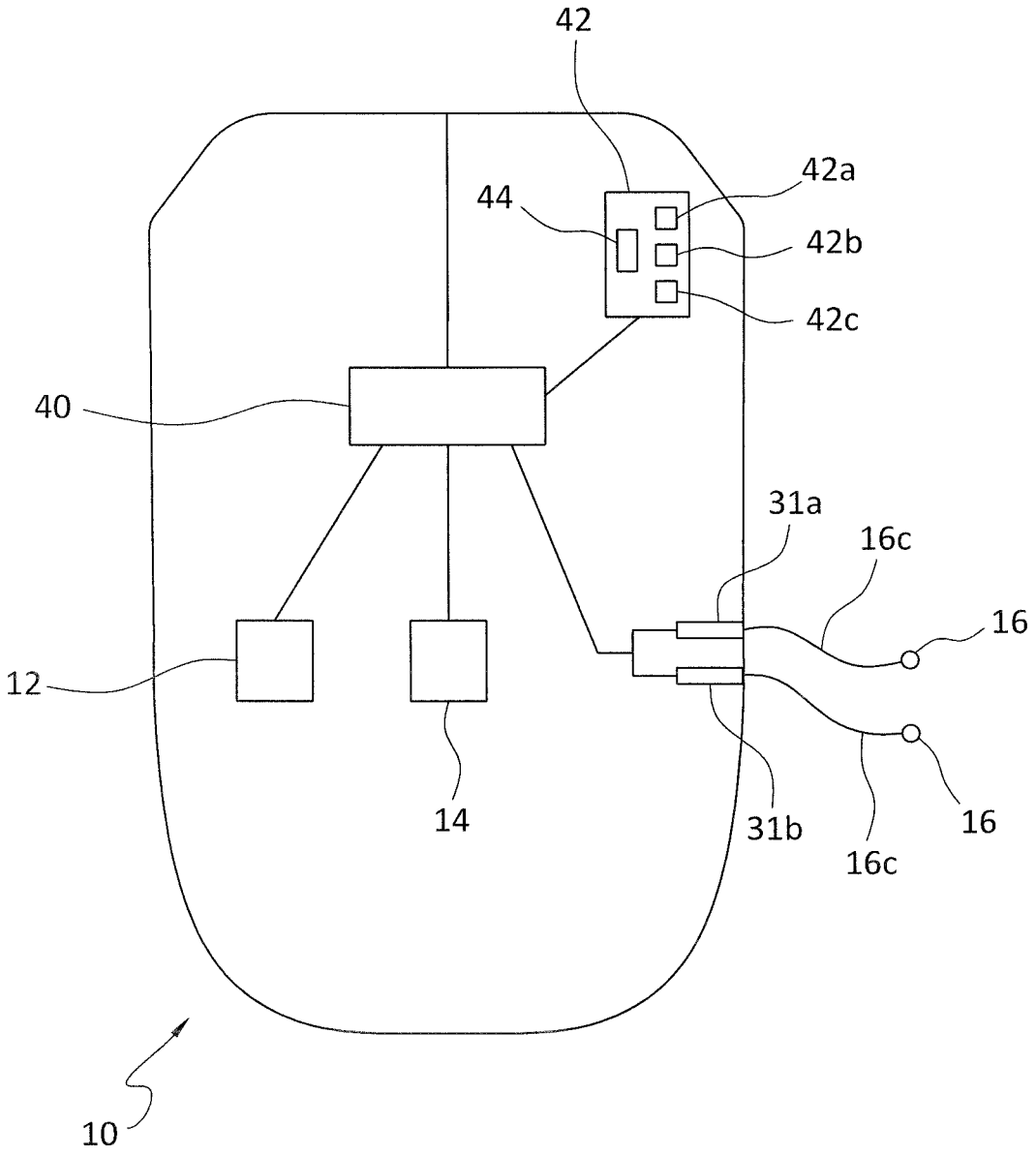
FIG. 5 is a schematic of the electronics and microphones of the conference microphone.

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

With reference to FIGS. 1 to 5, a multipurpose, multipattern boundary conference microphone 10 is disclosed. The conference microphone 10 is adapted for mounting upon a table or wall, and allows a user or installer to easily adapt it to any room with up to 20 ft.×20 ft. coverage. As will be appreciated based upon the following disclosure, the conference microphone 10 maybe readily adapted to suit the variety of specific applications and uses. The conference microphone 10 provides a directional boundary microphone 12, an omnidirectional microphone 14, and/or lavaliere microphone(s) 16 all in one microphone assembly to suit users having different needs and/or applications. In addition to working while when positioned on a desktop, the conference microphone 10 can go on a wall a foot or two above the desktop or tabletop.

The conference microphone 10 includes a housing 18 in the shape of a wedge. In addition to the various surfaces described below, the housing 18 includes a plurality of feet supporting it. In accordance with a preferred embodiment the housing 18 includes a plurality of rubber feet 19 on the bottom wall 22 thereof. The housing 18 may also be provided with a rubber type pad along its bottom wall. The feet 19, or the pad, will provide isolation between the functional elements of the conference microphone 10 and the support surface, and also help in maintaining the conference microphone 10 in place on the support surface. The housing 18 is substantially rectangular shaped when viewed from above and includes a top wall 20, a bottom wall 22, lateral side walls 24, 26 extending between the top wall 20 and the bottom wall 22, a front edge wall 28 extending between the top wall 20 and the bottom wall 22, and a rear edge wall 30 extending between the top wall 20 and the bottom wall 22. As the housing 18 extends from the rear edge wall 30 toward the front edge wall 28 thereof, the top wall 20 slopes downwardly creating a surface facing a person sitting opposite the housing 18. The microphones 12, 14, 16 of the present conference microphone 10 are mounted within or coupled to the housing 18. As such, a majority of the top wall 20 and lateral side walls 24, 26 are composed of a mesh material allowing for the passage of audio therethrough such that it may be picked up by the microphones 12, 14 without distortion.

Within the cavity defined by the housing 18 are housed the directional boundary microphone 12 and the omnidirectional microphone 14. The lavaliere microphone(s) 16 is connected to the housing 18 via two auxiliary microphone inputs 31*a*, 31*b*. The auxiliary microphone inputs can also be used to test any microphone that can be put on the ceiling or wall for possible consideration in a possible conferencing application. In accordance with the present invention the directional boundary microphone 12 includes a plurality of small microphone capsules 12*a-c* positioned near, or flush with, the bottom wall 26 of the housing 18. The microphone capsules 12*a-c* used in accordance with the present invention exhibit a directional polar pick-up pattern such as cardioid. In accordance with a preferred embodiment, the microphone capsules 12*a-c* are three (3) cardioid condenser capsules arranged in a pyramid with the input end facing away from the rear edge wall 30 of the housing 18. As those skilled in the art will appreciate, cardioid type microphones are good at rejecting sounds from the side and rear thereof and are therefore commonly used as vocal or speech microphones.

As to the omnidirectional microphone 14, it is constructed to pick up sound with equal gain from all sides or directions. As such, whether a user speaks into the microphone 14 from the front, back, left or right side, the omnidirectional microphone 14 will record the signals all with equal gain. In accordance with a preferred embodiment, the omnidirectional microphone 14 is composed of three microphone capsules 14*a-c*. Each of the microphone capsules 14*a-c* is an electret capsule providing 360 degree coverage.

The lavaliere microphone 16 is a small body worn microphone that is connected to the housing 18 via a cable 16*c* connected to one of two auxiliary microphone inputs 31*a*, 31*b* of the housing 18. Through the provision of two auxiliary microphone inputs 31*a*, 31*b*, the present conference microphone 10 allows for the connection, and use, of first and second lavaliere microphones 16 when the lavaliere microphones 16 are activated as explained below. Utilization of the lavaliere microphones 16 in conjunction with the conference microphone 10 allows for placement of the microphones much closer to the speaker (for example, on his or her clothing) and, therefore, allows the speaker to speak in a softer voice. This is especially advantageous when a conversation involves sensitive material as it minimizes the possibility of someone else overhearing the sensitive conversation. While the lavaliere microphones are contemplated for connection with the auxiliary microphone inputs 31*a*, 31*b* in accordance with a preferred embodiment, it is appreciated other microphones may be connected as desired, for example, an external omnidirectional microphone or directional boundary microphone 17*a* could be connected to either of the auxiliary microphone inputs 31*a*, 31*b*.

Further still, ceiling microphone(s) 17*b* could be plugged into the auxiliary microphone inputs 31*a*, 31*b* providing great flexibility in the usefulness of the conference microphone 10. For example, when using ceiling microphone(s) 17*b* with the conference microphone 10 mounted on a surface other than on a table, and one or two ceiling microphones 17*b* plugged into one or both of the two auxiliary microphone inputs 31*a*, 31*b*, a conferencing table is kept free of wires or microphones that could be moved or disconnected unintentionally.

Each of the directional boundary microphone 12, the omnidirectional microphone 14, and the lavaliere microphones 16 (via the auxiliary inputs 31*a*, 31*b*) are connected to a microprocessor 40 including a switching function. Selection regarding which microphone is to be used is achieved via actuation of the microprocessor 40. The microprocessor 40 is linked to a control panel 42 positioned along the top wall 20 of the housing 18 for actuation by a user of the conference microphone 10. In accordance with a preferred embodiment, the control panel 42 includes tri-colored lights 42*a-c* used to designate which microphone 12, 14, 16 is active and a momentary contact switch 44 used for switching between the various microphones 12, 14, 16. Further still, the control panel 42 is provided with a mute button 46. The microphones 12, 14, 16, via the microprocessor 40, are linked to an external audio processor (not shown) via a USB input/output (not shown) in a conventional manner.

Figure 6:
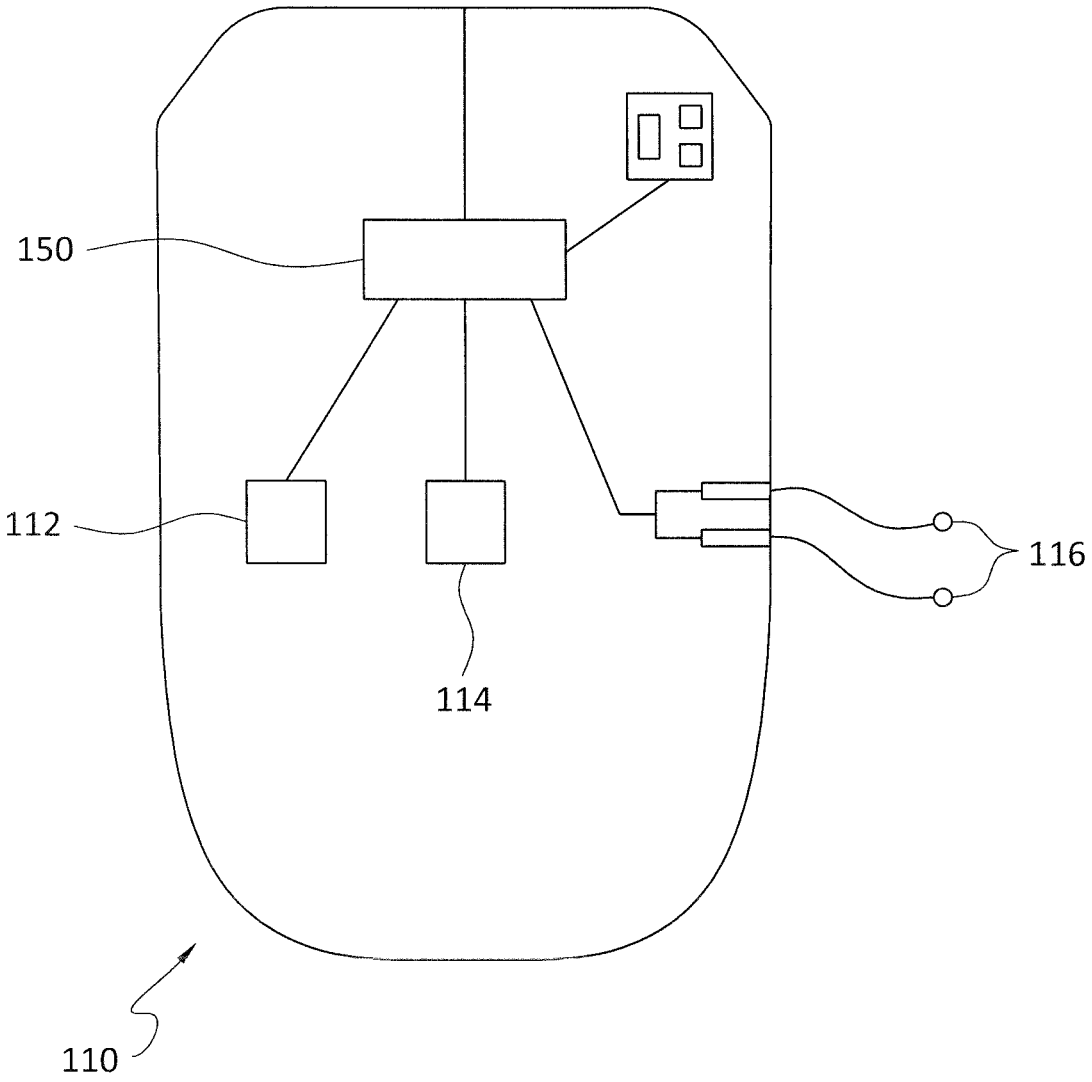
FIG. 6 is a schematic of the electronics and microphones in accordance with an alternate embodiment of the conference microphone.
Figure 7:
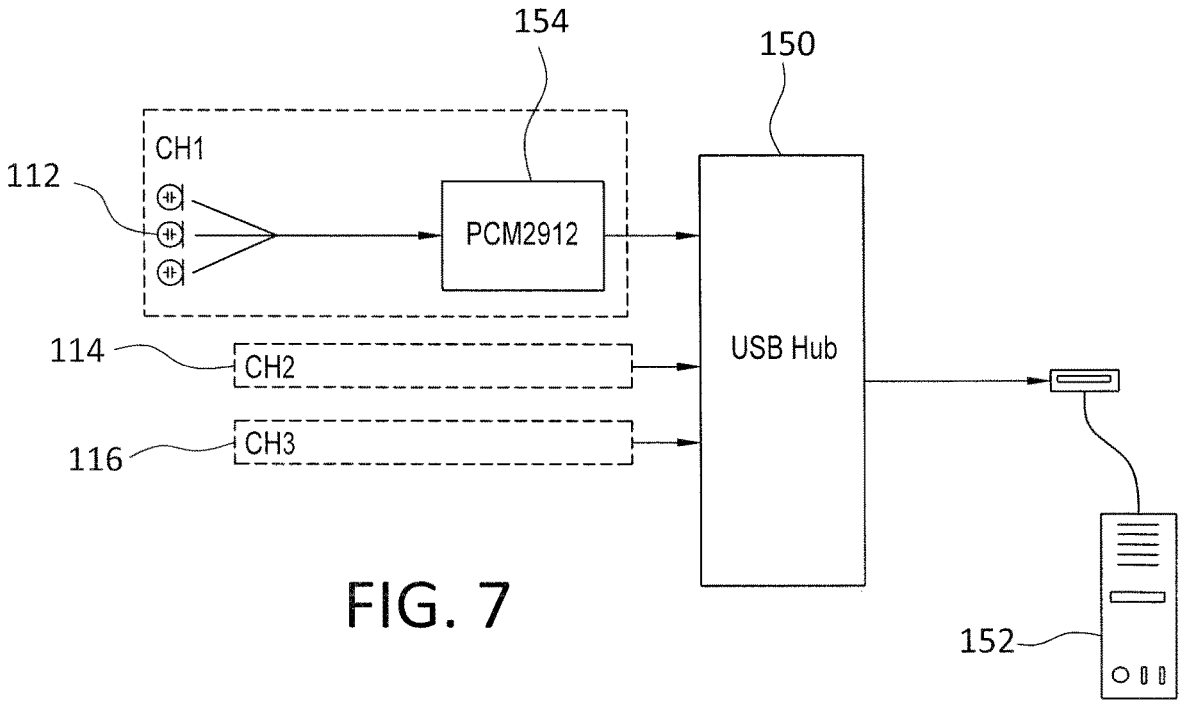
FIGS. 7 and 8 show alternate embodiments of the electronics associated with the conference microphone of FIG. 6.
Figure 8:
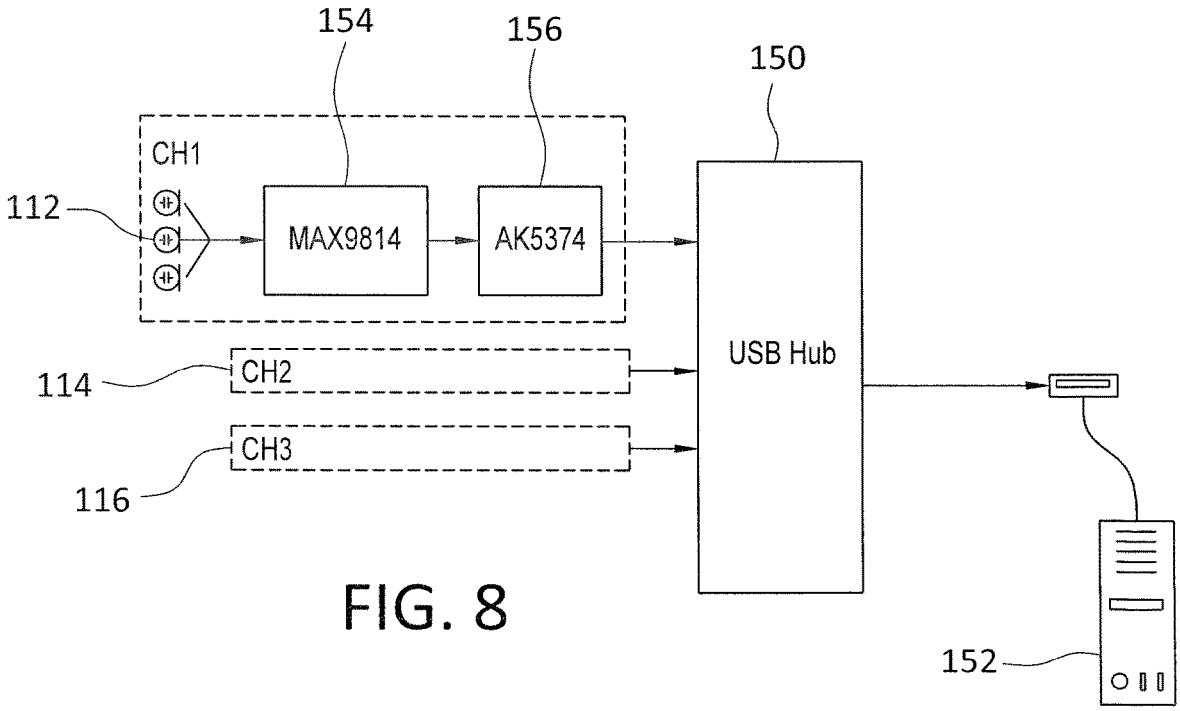

In accordance with an alternate embodiment of the present invention, and with particular reference to FIGS. 6, 7, and 8, use of the conference microphone 110 may be achieved with an internal USB Hub 150 that can control the pattern switch and volume from an external remote computer 152 (in addition to performing the functions of the microprocessor 40 described in accordance with the prior embodiment). As those skilled in the art will appreciate, control of the conference microphone 110 in accordance with such an embodiment may be achieved by directly inputting instruction via the computer 152 directly connected to the USB Hub 150 or control may be achieved via various networking techniques known to those skilled in the art. While such an embodiment includes a USB Hub 150 allowing for communication with and control by a remote computer, the conference microphone 110 necessarily includes the same functional components as discussed above.

In accordance with one implementation of this embodiment, and with reference to FIG. 7, each of the directional boundary microphone 112, the omnidirectional microphone 114, and/or the lavaliere microphone(s) 116 operates in conjunction with a 16-bit ADC (analog to digital converter). In particular, each of the directional boundary microphone 112, omnidirectional microphone 114, and/or lavaliere microphone(s) 116 is connected to an audio CODEC with an onboard USB interface and microphone input 153 (for example, a PCM 2912 printed circuit board), which is ultimately connected to the USB Hub 150 discussed above. Alternately, and with reference to FIG. 8, each of the directional boundary microphone 112, the omnidirectional microphone 114, and/or the lavaliere microphone(s) 116 may operate in conjunction with a 24-bit ADC (analog to digital converter). In particular, each of the directional boundary microphone 112, the omnidirectional microphone 114, and/or the lavaliere microphone(s) 116 is connected to a microphone amplifier with automatic gain control 154 (for example, a MAX 9814 low-cost, high-quality microphone amplifier with automatic gain control and low-noise microphone), which is connected to a stereo analog-to-digital converter having a USB interface 156 (for example, an AK5374 analog-to-digital converter), which is ultimately connected to the USB Hub 150.

The USB Hub 150 is connected to a computer 152 for control and operation of the conference microphone 110 in accordance with the present invention. The USB Hub 150 is addressable from anywhere through computer software to control operation of the conference microphone 110, including, but not limited to, switching between microphones 112, 114, 116, adjusting the volume, mute, and/or adding extra voice audio processing to any one of the microphones 112, 114, 116.

The computer software may be specifically operating on the computer 152 to which the USB Hub 150 is connected or the computer software may be operating on a remote computer connected to the computer to which the USB Hub 150 is connected via a network in a manner well known to those skilled in the art. The computer software provides a graphical user interface allowing a user to control the operation of the conference microphone 110 to optimize the usefulness thereof. In accordance with a preferred embodiment, the conference microphone 110 employs a graphical user interface as developed and distributed by the Zoom Video Communications, Inc. The Zoom graphical user interface provides for total control of the microphones 112, 114, 116 used in accordance with the present invention. The Zoom graphical user interface is designed to use standard/default USB driver(s) provided by Windows OS or/and Mac OS to interface their software, and the Zoom graphical user interface is, therefore, easily integrated for use in conjunction with the conference microphone 110. The Zoom graphical user interface provides for control of the conference microphone 110 by a single person and from anywhere.

Through the implementation of the present conference microphone 10, 110 users may switch amongst the various audio pick-up patterns offered by the directional boundary microphone 12, 112, the omnidirectional microphone 14, 114, and the lavaliere microphone(s) 16, 116 through actuation of a single button, that is, the contact switch 44, that operates the electronic switch of the microprocessor 40 (or via actuation of the computer 152 discussed above in accordance with an alternate embodiment). As such, the present conference microphone 10, 110 allows easy, enjoyable, and immediate set-up or pattern selection for 1-5 participants in a huddle room or many more within a 20-25 foot conferencing area.

The conference microphone 10, 110 of the present invention can be used as test microphone for setting up or designing conferencing rooms, as simple as huddle spaces to large rooms. Most people have difficulty in judging what is the best type of microphone to use in a particular conference room or what pattern will give the best clarity. The conference microphone 10, 110 of the present invention is a valuable tool to assist in setting up conference rooms as it allows one to switch from pattern to pattern quickly and determine which type of microphone is best suited for a particular conference room application. It is further contemplated two (2) or more conference microphones in accordance with the present invention can be used together to try different configurations by plugging the conference microphones into different USB inputs of a computer either directly or through a USB Hub.

In addition to the various features disclosed above, it is appreciated additional features may be added to the conference microphone including, but not limited to, a built-in compressor, a noise gate, and/or AGC (automatic gain control)/ALC (automatic level control).

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A conference microphone comprising:

a housing;

a directional boundary microphone within the housing, the directional boundary microphone including three cardioid condenser capsules;

an omnidirectional microphone within the housing;

a lavaliere microphone selectively connected to the housing via at least one auxiliary microphone input; and a microprocessor linked to a control panel for actuation by a user to control which of the directional boundary microphone, the omnidirectional microphone and the lavaliere microphone are active.

2. The conference microphone of claim 1, wherein the three cardioid condenser capsules are arranged in a pyramid.

3. The conference microphone of claim 1, wherein the housing has a rear edge wall and the directional boundary microphone includes an input end facing away from the rear edge wall of the housing.

4. The conference microphone of claim 3, wherein the three cardioid condenser capsules of the directional boundary microphone are arranged in a pyramid.

5. The conference microphone of claim 1, wherein the control panel includes a mute button.

6. The conference microphone of claim 1, further including a USB Hub for connection of the conference microphone to a remote computer for control of the conference microphone.

7. The conference microphone of claim 1, further including a plurality of auxiliary microphone inputs.

8. The conference microphone of claim 1, wherein the housing includes a top wall, a bottom wall, lateral side walls extending between the top wall and the bottom wall, a front edge wall extending between the top wall and the bottom wall, and a rear edge wall extending between the top wall and the bottom wall, and wherein a majority of the top wall and lateral side walls are comprised of a mesh material allowing for the passage of audio therethrough.

9. The conference microphone of claim 3, further including a USB Hub for connection of the conference microphone to a remote computer for control of the conference microphone.

* * * * *